US005938796A

United States Patent [19]

Negri et al.

[11] Patent Number: 5,938,796

[45] Date of Patent: Aug. 17, 1999

[54] ALKALI SYSTEM FOR DYEING CELLULOSIC TEXTILES BY PADDING METHODS

[75] Inventors: Daniele Negri, Busto Arsizio, Italy; Andreas Schrell, Kriftel, Germany

[73] Assignee: DyStar Textilfarben GmbH & Co. Deutschland KG, Germany

[21] Appl. No.: 09/074,707

[22] Filed: May 8, 1998

[30] Foreign Application Priority Data

May 9, 1997 [DE] Germany ..... 197 19 610

[51] Int. Cl.[6] ..... D06P 3/66

[52] U.S. Cl. ..... 8/543; 8/529; 8/532; 8/533; 8/584; 8/918; 8/921

[58] Field of Search ..... 8/529, 532, 533, 8/543, 584, 918, 921

[56] References Cited

U.S. PATENT DOCUMENTS 4,088,441 5/1978 Meininger et al. .

4,555,348 11/1985 Moran .

5,167,668 12/1992 Hähnke et al. .

FOREIGN PATENT DOCUMENTS 0200131 4/1986 European Pat. Off. .

24 12 964 10/1975 Germany .

OTHER PUBLICATIONS

Riad et al, Retardation of Vat Dye Uptake on Cotton by Phosphonates, J Soc. Dyes Col (1993) 109(10) 336–7, Oct. 1993.

*Primary Examiner*—Margaret Einsmann

*Attorney, Agent, or Firm*—Connolly & Hotz

[57] ABSTRACT

Cellullosic textile materials are dyed by a pad or spraying process using a solution which contains 5–100 g/l of inorganic polyphosphate and has a pH of 10–13.5.

18 Claims, No Drawings

ALKALI SYSTEM FOR DYEING CELLULOSIC TEXTILES BY PADDING METHODS

Cellulosic textiles can be dyed by exhaust or padding methods or by textile printing. Of particular importance in this context are reactive dyes, which are capable of entering a covalent bond with the fiber during the dyeing process. The outstanding feature of reactive dyes is their good wetfastness level, which is very difficult, if not impossible, to achieve with other classes of dyes. However, reactive dyes, i.e., dyes containing a fiber-reactive group, can generally enter a covalent bond only if the dyeing process was carried out under alkaline conditions. The alkali donors used are carbonates, bicarbonates, hydroxides and—in pad dyeing—silicates in particular. The auxiliary chemicals are used as pure substances or in the form of mixtures. Carbonate/hydroxide mixtures in particular are very effective and are preferred. In general, the alkali system is matched to the particular reactive system of the reactive dye and the specific dyeing process.

In the dyeing industry the term "padding" designates the application of a treatment liquor to a textile web and a subsequent removal of excess liquor by squeezing. Two methods of application are differentiated in this context, one-step and two-step processes. Two-step processes, however, have the disadvantage of extensive equipment requirements and the use of salt in the second step. After impregnation of the web with a dye solution in a first step, the material is introduced into "boosters" (second step) where the material is loaded with an alkaline salt liquor (alkali and electrolyte salts). By contrast, in a one-step process, the complete treatment liquor, typically comprising reactive dye, alkali donors and optionally detergents, is applied to the material in one operation prior to the fixing step.

Fiber-reactive dyes having a fiber-reactive group of the vinyl sulfone series are very frequently applied in cold pad-batch processes using silicates in the form of waterglass ($Na_2O:SiO_2$, ratio 1:2 to 1:3.5) as alkali donors. The dyeing liquor further comprises between 6 and 40 ml/l of about 32.5% strength by weight aqueous sodium hydroxide solution. Waterglass has a pH-buffering effect and improves the pad liquor stability of reactive dyes. A positive effect which has to be mentioned in this context is the protection afforded to the edges of the rolled-up material against ambient carbon dioxide.

However, the use of waterglass is not all advantageous. Disadvantages are that waterglass tends to crystallize (foul the machines) and that there is no way to neutralize prior to the washing process, that the use in steaming processes is not unreservedly possible and that, moreover, unattractive hand effects arise in some cases.

It is an object of the present invention to provide an alkali system which avoids the above-described disadvantages.

U.S. Pat. No. 4,555,348 describes a liquid buffer system suitable for use as an exhaust dyebath additive, which is composed of trisodium or tripotassium phosphate and sodium hydroxide and has a pH between 11 and 13.

It was found that, surprisingly, low molecular weight and high molecular weight polyphosphates are useful as replacements for silicates in padding processes. The low molecular weight metapolyphosphates are also suitable for this purpose. This effect is surprising especially because the salts of polyphosphoric acids form solutions having a neutral pH.

The present invention accordingly provides a process for dyeing cellulosic textiles by padding or spraying with a liquor or solution comprising 5 to 100 g/l, preferably 7 to 40 g/l, especially 10 to 20 g/l, of an inorganic polyphosphate and having a pH of 10 to 13.5, preferably of 11 to 13.

Inorganic polyphosphates are generally salts of polyphosphoric acids, which are derived from these acids by condensation processes. The condensed phosphoric acids are classified into linear polyphosphoric acids $H_{n+2}P_nO_{3n+1}$ and cyclic metapolyphosphoric acids $H_nP_nO_{3n}$, which are derived from the former by ring closure and $H_2O$ elimination and can be converted back into them by hydrolysis. Whereas the number n of the phosphorus atoms in the ring-shaped metapolyphosphoric acids and their salts is comparatively small at 3 to 8, it can become significantly higher in the open-chain polyphosphoric acids and their salts.

There are low molecular weight polyphosphates $M_{n+2}P_nO_{3n+1}$ (where n=2 to 10) and high molecular weight polyphosphates $M_nH_2P_nO_{3n+1}$ (where n=11 to 90), where two terminal hydrogen atoms, which have only very minimal acid character, are not replaced by metal atoms and whose composition comes very close to that of the formula $M_nP_nO_{3n}$ of the metaphosphates, M here being in each case an alkali metal, such as sodium or potassium.

The low molecular weight polyphosphates $M_{n+2}P_nO_{3n+1}$ are generally obtained by dehydration of a mixture of primary and secondary monophosphates in various molar ratios and at various temperatures. Examples are the pentabasic triphosphoric acid $H_5P_3O_{10}$ and the hexabasic tetraphosphoric acid $H_6P_4O_{13}$ and also their salts. These phosphates are already in use as water softeners. The cyclic metapolyphosphates $M_nP_nO_{3n}$ are generally formed by ring closure and water elimination from polyphosphates $M_nH_2P_nO_{3n+1}$ obtained on heating primary monophosphates.

Examples of the high molecular weight polyphosphates of the formula $Na_nH_2P_nO_{3n+1}$ are Graham's salt, Maddrell's salt and Kurrol's salt. Graham's salt is formed by heating $NaH_2PO_4$ to above 600° C. and consists of chains of 30 to 90 phosphorus atoms.

The preparation of the various polyphosphates is known to one of ordinary skill in the art and can be read up in the literature.

The polyphosphates can be added both as solids directly and in the form of their solutions to the water of the dyeing liquor. Mixtures of the polyphosphates mentioned can be used as well. The requisite pH can be set by addition of an appropriate amount of alkali, such as sodium hydroxide or sodium carbonate, to the dye bath.

The polyphosphates can be used as alkali donors or pH buffers instead of silicates in any padding processes. These processes include the well known cold pad-batch process, the pad-dry-pad-steam process, the pad/air-steam process and the thermosol/pad-steam process.

In the pad-dry-pad-steam process, the fabric to be dyed is intermediately dried following the application of the dye; thereafter the alkaline salt liquor is padded on and subsequently the reactive dye is fixed at steam temperatures of about 100 to 103° C.

In the pad/air-steam process, the alkaline dyeing liquor is padded on and steamed for 2 to 3 minutes at about 120° C. and a wet-bulb temperature of the material of about 70° C. with a relative humidity of about 20%.

In the thermosol/pad-steam process (for blend articles, such as polyester/cotton), first a disperse and reactive dye is padded on and the material is dried at about 120° C. It is then heat-set at about 180° C. and subsequently an alkaline salt liquor is padded on. This is followed by an approximately 1-minute steaming process at about 102° C.

By spraying is meant a no-contact technique for applying the dyeing liquor, for example an ink-jet process.

The process of the present invention is particularly suitable for dyeing with fiber-reactive dyes. Fiber-reactive dyes are organic dyes which contain 1, 2, 3 or 4 fiber-reactive radicals of the aliphatic, aromatic or heterocyclic series which are capable of reacting with the hydroxyl groups of cellulose, or with the amino groups and any carboxyl groups of polyamides, to form covalent chemical bonds. These dyes are described in the literature in large numbers. They can belong to a wide range of dye classes, for example the class of the monoazo, bisazo, polyazo and metal complex azo dyes, such as 1:1 copper, 1:2 chromium and 1:2 cobalt complex monoazo and bisazo dyes, and also the series of the anthraquinone dyes, copper, nickel and cobalt phthalocyanine dyes, copper formazan dyes, azomethine, nitroaryl, dioxazine, triphendioxazine, phenazine and stilbene dyes. The fiber-reactive radical can be attached to the dye radical directly or via a bridge member; it is preferably attached to the dye radical directly or via a possibly monoalkylated amino group, for example a group of the formula —NH—, $—N(CH_3)—_1$ $—N(C_2H_5)—$ or $—N(C_3H_7)—_1$ or via an aliphatic radical, such as methylene, ethylene, propylene or an alkylene radical of 2 to 8 carbon atoms which is interrupted by one or two oxy and/or amino groups, or via an amino-containing bridge member, for example via a phenylamino group.

Fiber-reactive radicals are for example: vinylsulfonyl, β-chloroethylsulfonyl, β-sulfatoethylsulfonyl, β-acetoxyethylsulfonyl, β-phosphatoethylsulfonyl, β-thiosulfatoethylsulfonyl, N-methyl-N-(β-sulfatoethylsulfonyl)amino, acryloyl, $—CO—CCl=CH_2$, —CO—CH=CH—Cl, —CO—CCl=CHCl, $—CO—CCl=CH—CH_3$, $—CO—CBr=CH_2$, —CO—CH=CH—Br, $—CO—CBr=CH—CH_3$, —CO—CCl=CH—COOH, —CO—CH=CCl—COOH, —CO—CBr=CH—COOH, —CO—CH=CBr—COOH, —CO—CCl=CCl—COOH, —CO—CBr=CBr-COOH, β-chloro- or β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobut-1-yl)acryloyl, α- or β-methylsulfonylacryloyl, propiolyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichlorotriazin-6-yl, 2,4-dichloropyrimidin-6-yl, 2,4,5-trichloropyrimidin-6-yl, 2,4-dichloro-5-nitro- or 5-methyl- or -5-carboxymethyl- or -5-carboxy- or -5-cyano- or -5-vinyl- or -5-sulfo- or -5-mono-, -di- or -trichloromethyl- or -5-methylsulfonylpyrimidin-6-yl, 2,5-dichloro-4-methylsulfonylpyrimidin-6-yl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6chloromethyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl- or -5-methylsulfonyl-4-pyrimidinyl, 2-fluoro-5-carboxamido-4-pyrimidinyl, 2-fluoro-5-carbomethoxy-4-pyrimidinyl, 2-fluoro-5-bromo-6-trifluoromethyl-4-pyrimidinyl, 2-fluoro-6-carboxamido-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-bis(methylsulfonyl)pyrimidin-4-yl, 2,5-bis(methylsulfonyl)-5-chloropyrimidin-4-yl, 2-methylsulfonylpyrimidin-4-yl, 2-phenylsulfonylpyrimidin-4-yl, 2-methylsulfonyl-5-chloro-6-methylpyrimidin-4-yl, 2-methylsulfonyl-5-bromo-6-methylpyrimidin-4-yl, 2-methylsulfonyl-5-chloro-6-ethylpyrimidin-4-yl, 2-methylsulfonyl-5-chloromethylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin-4-yl, 2,6-bis(methylsulfonyl)-5-chloropyrimidin-4-yl, 2-methylsulfonyl-6 -carboxypyrimidin-4-yl, 2-methylsulfonyl-5-sulfopyrimidin-4-yl, 2-methylsulfonyl-6-carbomethoxypyrimidin-4-yl, 2-methylsulfonyl-5-carboxypyrimidin-4-yl, 2-methylsulfonyl-5-cyano-6-methoxypyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloropyrimidin-4-yl, 2-carboxymethylsulfonyl-5-chloro-6-methylpyrimidin-4-yl, 2,4-dichloropyrimidine-6carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl or -5-sulfonyl, 2-methylsulfonyl-6-chloropyrimidine-4- and -5-carbonyl, 2,6-bis(methylsulfonyl)pyrimidine-4- or -5-carbonyl, 2-ethylsulfonyl-6-chloropyrimidine-5-carbonyl, 2,4-bis(methylsulfonyl)pyrimidine-5-sulfonyl, 2-methylsulfonyl-4-chloro-6-methylpyrimidine-5-sulfonyl or -5-carbonyl, 2-chloroquinoxaline-3-carbonyl, 2- or 3-monochloroquinoxaline-6-carbonyl, 2- or 3-monochloroquinoxaline-6-sulfonyl, 2,3-dichloroquinoxaline-5- or -6-carbonyl, 2,3-dichloroquinoxaline-5- or 6-sulfonyl,1,4-dichlorophthalazine-6-sulfonyl or -6-carbonyl, 2,4-dichloroquinazoline-7- or -6-sulfonyl or -carbonyl, 2,4,6-trichloroquinazoline-7- or -8-sulfonyl, 2- or 3- or 4-(4',5'-dichloropyridaz-6'on-1'-yl)phenylsulfonyl or -carbonyl, β-(4',5'-dichloropyridazin-6'-on-1'-yl)propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl or -5- or -6-sulfonyl, such as 2-methylsulfonyl- or 2-ethylsulfonylbenzothiazole-5- or -6-sulfonyl or -carbonyl, 2-phenylsulfonylbenzothiazole-5- or -6-sulfonyl or -carbonyl and the corresponding 2-sulfonylbenzothiazole-5- or -6-carbonyl or -sulfonyl derivatives with sulfo groups in the fused-on benzene ring, 2-chlorobenzoxazole-5- or 6-carbonyl or -sulfonyl, 2-chlorobenzimidazole-5- or -6-carbonyl or -sulfonyl, 2-chloro-1 -methylbenzimidazole-5- or -6-carbonyl or -sulfonyl, 2-chloro-4-methylthiazole(1,3)-5-carbonyl or -4- or -5-sulfonyl; ammonium-containing triazine rings, such as 2-trimethylammonium-4-phenylamino- and -4-(o-, m- or p-sulfophenyl)amino-6-triazinyl, 2-(1,1-dimethylhydrazinium)-4-phenylamino- and -4-(o-, m- or p-sulfophenyl)amino-6-triazinyl, 2-(2-isopropylidene- 1,1-dimethyl)hydrazinium-4-phenylamino- and -4-(o-, m- or p-sulfophenyl)amino-6-triazinyl, 2-N-aminopyrrolidinium-, 2-N-aminopiperidinium-4-phenylamino- or 4-(o-, m- or p-sulfophenyl)amino6-triazinyl, 4-phenylamino- or 4-(sulfophenylamino)-6-triazinyl which contain 1,4-bisazabicyclo[2.2.2] octane or 1,2-bisazabicyclo[0.3.3] octane attached in quaternary fashion in the 2-position via a nitrogen bond, 2-pyridinium-4-phenylamino- or -4-(o-, m- or p-sulfophenyl)amino6-triazinyl and corresponding 2-onium-6-triazinyl radicals which are substituted in the 4-position by alkylamino, such as methylamino, ethylamino or β-hydroxyethylamino, or alkoxy, such as methoxy or ethoxy, or aryloxy, such as phenoxy or sulfophenoxy.

Particularly interesting fiber-reactive radicals are fluoro- and chloro-1,3,5-triazine radicals of the general formula

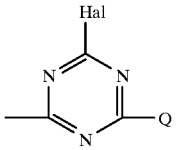

where Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino, N-alkyl-N-arylamino group or an amino group.

In a preferred embodiment, the dyeing liquor comprises 0.1 to 140 g/l of dye, 5 to 100 g/l of the inorganic polyphosphate, 5 to 80 ml/l of 20 to 38% strength by weight aqueous sodium hydroxide solution and 0.1 to 5 g/l of an anionic wetting agent. The dyeing liquor is advantageously squeezed onto the fabric in a padmangle. After winding onto a batching roller, the material is left at room temperature for 4 to 24 hours; the reactive dye becomes fixed during this period. The fixing phase is followed by a customary washoff process, in which the material can also be acidified.

The cellulosic textiles can consist of natural cellulose fibers, such as cotton, linen and hemp, or be pulp, regenerated cellulose or else cellulose modified by cationic groups or groups having an affinity for anions. Blend fabrics, such as blends of cotton with polyester fibers or polyamide fibers, are also contemplated.

The Examples which follow illustrate the invention. Parts and percentages are by weight, unless otherwise stated. Parts by weight relate to parts by volume as the kilogram to the liter.

EXAMPLE 1

10 parts of a bleached cotton fabric are impregnated at room temperature to a wet pickup of 80%, based on the weight of the fabric, with an aqueous liquor comprising a mixture of 10 parts each of the dyes of the formulae

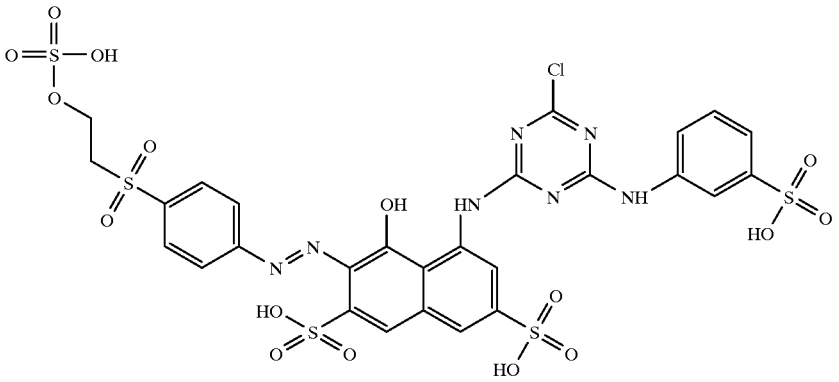

-continued

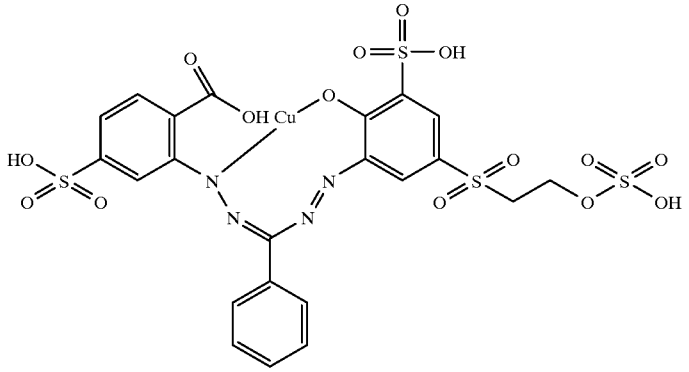

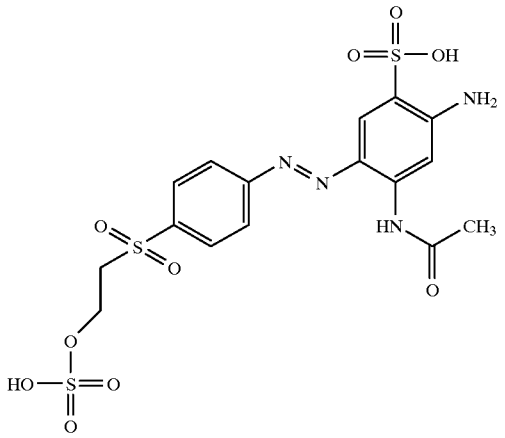

10 parts of Graham's salt and 10 ml of 38° Be aqueous sodium hydroxide solution. Following a dwell time of 12 h at room temperature, the material is subjected to a customary washoff process for reactive dyings. The reddish brown dyeing obtained has a 10% deeper shade compared with the standard procedure, involving waterglass and sodium carbonate. The fastness level is satisfactory.

EXAMPLE 2

A mercerized cotton fabric having a weight of about 120 g/m$^2$ is padded to a wet pickup of 80% at 20° C. with an aqueous liquor comprising 50 g/l of the reactive dye of the formula

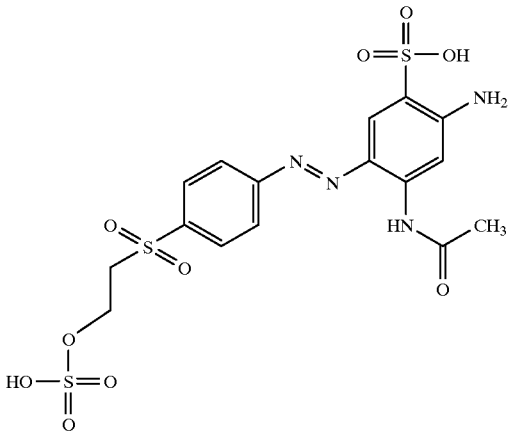

18 ml/l of 32.5% strength by weight aqueous sodium hydroxide solution, 15 g/l of Graham's salt and 3 g/l of an anionic wetting agent, e.g., Leonil SRP. The impregnated material is passed at 20 m/min into a fixing unit where the temperature is 120° C. and the relative humidity is 25% and fixed at a wet-bulb temperature of 70° C. for 2.5 minutes. The dyed material then leaves the fixing unit with a residual moisture content of 15%. The material is then subjected to a continuous wash-off process and finished.

The material is notable for a very uniform appearance and a smooth surface. The depth of shade is 20% deeper than on a textile dyed by the conventional pad-dry-pad-steam method.

EXAMPLE 3

A viscose fabric having a weight of about 100 g/m$^2$ is padded to a wet pickup of 90% at a temperature of 20° C. with an aqueous liquor comprising 50 g/l of the reactive dye C. I. Reactive Red 180 of the formula

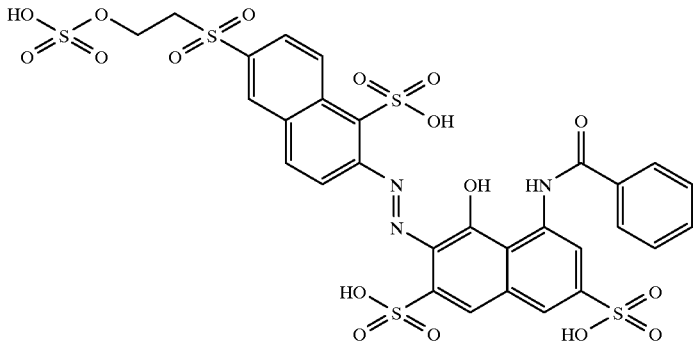

18 m/l of 32.5% by weight aqueous sodium hydroxide solution, 15 g/l of Maddrell's salt and 2 g/l of an anionic wetting agent, e.g., Leonil SRP. The dye is fixed as described in Example 2 and the material is finished in a conventional manner. The strong red dyeing has a 20% deeper shade than a material colored with the same amount of dye by a pad-steam process. The fastness level is that expected of reactive dyes. The material has a significantly better hand than a material dyed by the waterglass method.

What is claimed is:

1. A process for dyeing a textile by padding or spraying a cellulosic textile with a dye liquor comprising a fiber-reactive dye and 5 to 100 g/l of one or more inorganic polyphosphates said liquor having a pH of 10 to 13.5.

2. The process of claim 1, wherein the liquor comprises 7 to 40 g/l of the inorganic polyphosphate.

3. The process of claim 1, wherein the liquor comprises 10 to 20 g/l of the inorganic polyphosphate.

4. The process of claim 1, wherein the liquor has a pH of 11 to 13.

5. The process of claim 1, wherein the inorganic polyphosphate or mixture thereof is selected from those having the formula $M_{n+2}P_nO_{3n+1}$, where M is an alkali metal and n is 2 to 10, $M'_{N'}H_2P_{n'}O_{3n'}+1$, where M' is an alkali metal and n' is 11 to 90 and $M''_{n''}P_{n''}O_{3n''}$, where M" is an alkali metal and n" is at least 3.

6. The process of claim 5, wherein n" is 3 to 8.

7. The process of claim 5, wherein the inorganic polyphosphate consists essentially of a compound of said formula $M_{n+2}P_nO_{3n+1}$.

8. The process of claim 5, wherein the inorganic polyphosphate consists essentially of a compound of said formula $M'_{n'}H_2P_{n'}O_{3n'+1}$.

9. The process of claim 5, wherein the inorganic polyphosphate consists essentially of a cyclic compound of said formula $M''_{n''}P_{n''}O_{3n''}$.

10. The process of claim 1, wherein the inorganic polyphosphate is a salt of triphosphoric acid or of tetraphosphoric acid.

11. The process of claim 1, wherein the inorganic polyphosphate is Graham's salt, Maddrell's salt or Kurrol's salt.

12. The process of claim 1, wherein the inorganic polyphosphate has been added to the liquor as a solid or as an aqueous solution containing the inorganic polyphosphate.

13. The process of claim 1, wherein the padding is effected as a cold pad-batch process, as a pad-dry-pad-steam process, as a pad/air-steam process or as a thermosol/pad-steam process.

14. The process of claim 1, wherein the liquor comprises 0.1 to 5 g/l of an anionic wetting agent.

15. The process of claim 1, wherein said cellulosic textile is cotton, linen, hemp, or regenerated cellulose, or a cellulosic fiber blended with a polyester or polyamide fiber.

16. The process of claim 1, wherein said liquor comprises an aqueous solution.

17. The process of claim 1, wherein the pH of said liquor has been adjusted to 11 to 13 with sodium hydroxide or sodium carbonate.

18. A method for replacing a silicate of the padding liquor of an alkaline padding process for applying a dye to a textile web, comprising the step of replacing the silicate with a polyphosphate having an essentially neutral pH and adjusting the pH of the resulting liquor to 10 to 13.5 by adding alkali.

* * * * *